US005901711A

United States Patent [19]

Jeremy

[11] Patent Number: 5,901,711

[45] Date of Patent: May 11, 1999

[54] HAIR ROLLER ASSEMBLY

[76] Inventor: Cheung Chi Kong Jeremy, Flat F, 12/F Block 4, Beacon Height, 4 Lung Ping Rd., Kowloon, The Hong Kong Special Administrative Region of the People's Republic of China

[21] Appl. No.: 09/062,775

[22] Filed: Apr. 20, 1998

[51] Int. Cl.[6] ..... A45D 2/12; A45D 1/02; A45D 7/02

[52] U.S. Cl. ..... 132/226; 132/227; 132/212

[58] Field of Search ..... 132/226, 227, 132/212, 262

[56] References Cited

U.S. PATENT DOCUMENTS

| | | | |
|---|---|---|---|
| 3,675,663 | 7/1972 | Calandra | 132/33 |
| 4,569,360 | 2/1986 | Glucksman | 132/226 |
| 4,576,188 | 3/1986 | Barradas | 132/39 |
| 4,598,722 | 7/1986 | Doyle | 132/226 |
| 4,699,159 | 10/1987 | Thaler | 132/226 |
| 5,286,949 | 2/1994 | Simons | 219/222 |
| 5,482,060 | 1/1996 | Barradas | 132/226 |
| 5,522,408 | 6/1996 | Wiegner | 132/262 |

*Primary Examiner*—John J. Wilson
*Assistant Examiner*—Trang Doan
*Attorney, Agent, or Firm*—Sidney N. Fox

[57] ABSTRACT

A hair roller which is comprised of three concentric sleeves. An outer sleeve is of a plastic, woven-type material that has a plurality of projections with hooked shaped ends capable of gripping hair. A central sleeve is comprised of a metallic material having good heat transfer characteristics. An inner sleeve is comprised of a flexible, resilient plastic material which provides the hair roller with more rigidity and acts as an insulator.

8 Claims, 1 Drawing Sheet

HAIR ROLLER ASSEMBLY

FIELD OF THE INVENTION

The present invention is drawn to hair rollers used to form and shape hair.

BACKGROUND OF THE INVENTION

Presently hair rollers are comprised of two pieces. A first piece is used to secure hair onto a second piece.

There are several problems with the present hair rollers. First since the hair rollers have two pieces many times pieces get lost and the hair roller becomes unuseable. Second when styling hair using heat, the rollers do not help in the distribution of heat. Therefore it takes more time to style the hair. Manufacturers have addressed this problem by making heated rollers. However the rollers still take a long time to heat and once the rollers are hot they are very hard to handle.

SUMMARY OF THE INVENTION

It is an object of the present invention to overcome the above problems encountered in prior arts and to provide a light weight, easy to use hair roller.

In accordance with one aspect of the present invention, the one piece hair roller includes a plurality of concentric sleeves or cylinders that are tightly mounted together so as to form a single piece. In a particular embodiment, there are three, hollow concentric sleeves. An outer sleeve is comprised of a plastic material that has a plurality of concentric circular rows of outwardly extending, flexible projections with hooks on the ends thereof such that the hooks are capable of engaging the hair of a user. A central sleeve is comprised of a thin, perforated metallic sheet that has only a partial cylindrical form. The inner sleeve is comprised of a relatively thicker, perforated plastic material that provides a resilient cylindrical shape to the roller. The outer and inner sleeves in this particular embodiment are complete cylinders.

Such a hair roller provides an even distribution of heat, is flexible, but resiliently retains its shape, and is perforated so as to permit air to penetrate the roller and thereby dry a roll of hair of a user.

DETAILED DESCRIPTION

The following is a specific example of and is illustrative of a preferred embodiment of the invention and is not to be construed as limiting the invention thereto.

Figure 1:
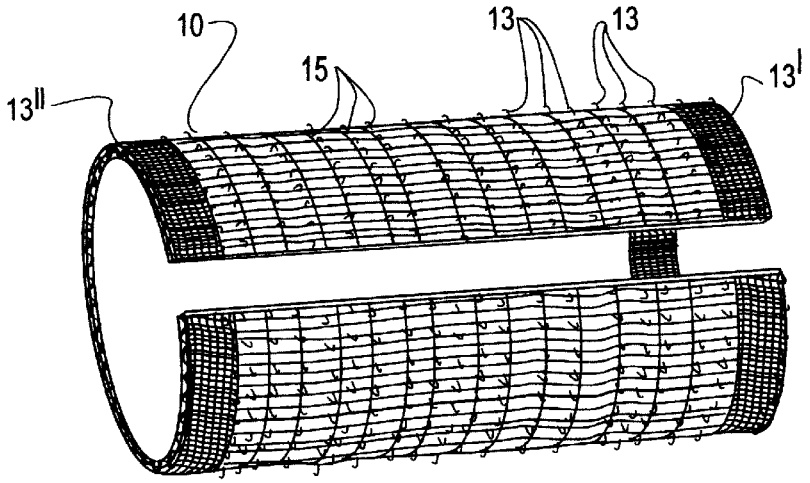
FIG. 1 is a perspective view of an outer sleeve of the hair roller, the sleeve having an axial cut so as to depict features of the sleeve.
Figure 4:
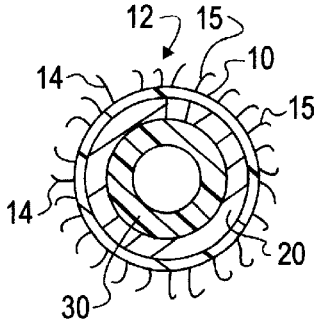
FIG. 4 is a cross-sectional view of an assembled hair roller with the sections being taken on the radial ridges and wherein the thicknesses and relative thicknesses of the sleeves have been exaggerated so as to depict the details thereof.

The present invention is now described with reference to the drawings in which like elements are denoted by like numerals throughout the several views. In particular with reference to FIGS. 1 and 4, an outer sleeve 10 is depicted of a hair roller 12. Outer sleeve 10 is made of a woven type, plastic material so that it is porous. Outer sleeve 10 has a plurality of thin, circumferential rows 13, each row having a plurality of flexible projections 14 extending radially outwardly therefrom. The ends of outer sleeve 10 have rows 13' and 13" that are much wider than inner rows 13. Each projection 14 has a hooked shaped end 15 which is capable of gripping the hair of a user (not shown). With outer sleeve 10 having a plurality of hooked shaped ends 15, it is not necessary to have a second piece to secure the hair to the outer sleeve because the hooks grip the hair keeping the hair attached to the outer sleeve. Therefore hair roller 12 can be unitary or one piece.

Figure 2:
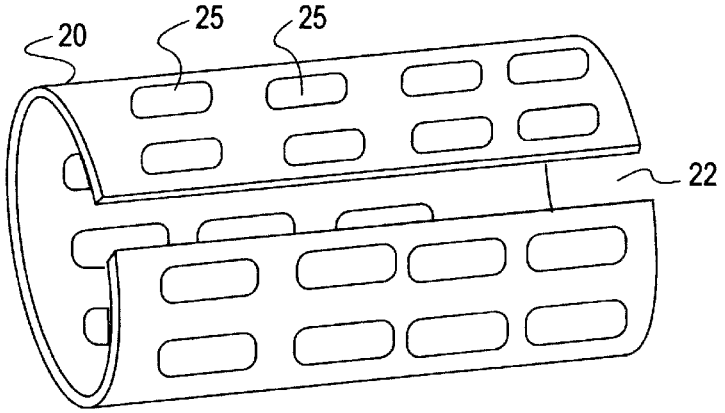
FIG. 2 is a perspective view of a central or a first inner sleeve of the hair roller.

A central or first inner sleeve 20 attached to the inside surface of outer sleeve 10 is depicted in FIG. 2. First inner sleeve 20 is split by an axial cut 22 so as to have opposing ends, and has a plurality of oblong openings or perforations 25. Sleeve 20 is comprised of a material that has good heat transfer characteristics such as aluminum, and is thicker than a conventional foil, an exemplary thickness being about 1/50th of an inch. Perforations 25 allow hair pins and other objects to pierce through hair roller 12 to keep the hair more securely attached to the hair roller, and also permit drying air to penetrate hair roller 12. With central sleeve 20 being comprised of a material having good heat transfer characteristics, such as a thin sheet of aluminum, the hair in contact with the roller is more evenly heated when styling with heat.

Figure 3:
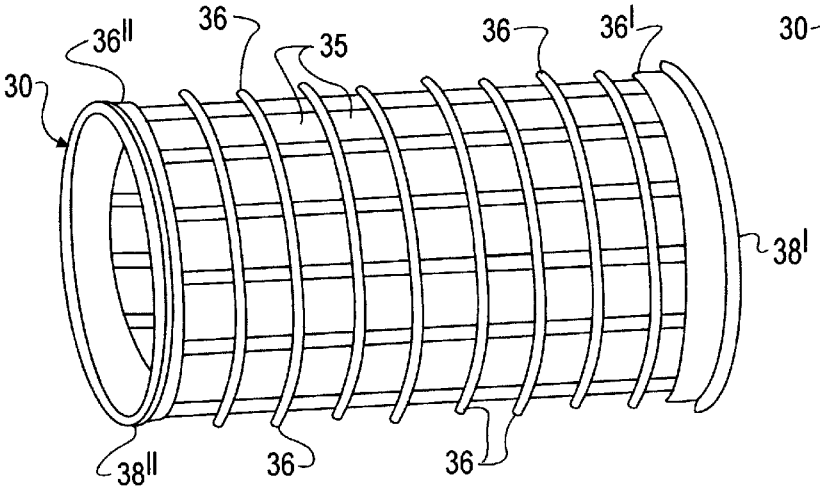
FIG. 3 is a perspective view of an innermost or second inner sleeve of the hair roller.

An innermost or second inner sleeve 30 attached to the inside surface of inner sleeve 20 is depicted in FIG. 3. Second inner sleeve 30 has a plurality of substantially square openings or perforations 35 and a plurality of circular coaxial rows of ridges 36, and is made of a resilient, flexible plastic material. The end ones of ridges 36, namely ridges 36' and 36", are wider than interior ridges 36 by a factor of about 3 and have a terminal annular projecting ridge 38' and 38". Perforations 35 allow air to penetrate through to the center of roller 12 as well as allow hair pins and other objects to pierce through hair roller 12 to keep the hair more securely attached to the hair roller. Second inner sleeve 30 also acts as an insulator so that when first inner sleeve 20 is heated the entire portion of roller 12 does not get hot making roller 12 difficult to handle. Instead second inner sleeve 30 acts as an insulator and protects the user from being burned. Second inner sleeve 30 also provides hair roller 12 with form and a flexible rigidity.

The invention thus being described, it will be obvious that the same may be varied in many ways. Such variations are not to be regarded as a departure from the spirit and scope of the invention, and all such modifications are intended to be included within the scope of the following claims.

What is claimed is:

1. A hair roller assembly comprising concentrically arranged surface to surface engaged an outer tubular sleeve, an inner plastic perforate support sleeve and an intermediate perforate sleeve therebetween;

said outer tubular sleeve comprised of a porous woven plastic material having plural spaced circumferential rows each including a plurality of radial outwardly extending flexible projections having hair-grasping hook shaped ends; and said tubular intermediate sleeve being formed of a highly heat conductive material and having plural rows of spaced oblong openings formed along the length thereof and said inner plastic perforate support sleeve being formed of plural spaced longitudinal parallel strips extending along the length thereof and spaced coaxial ridges unitary with said spaced longitudinal parallel strips thereby to define a plurality of openings along the length of said roller, said inner plastic perforate support sleeve being resilient and flexible.

2. A hair roller assembly as claimed in claim 1 wherein said intermediate sleeve is formed of a sheet of high heat conductivity material having a thickness of about 1/50th of an inch.

3. A hair roller assembly as claimed in claim 1 wherein said intermediate sleeve is made of aluminum.

4. A hair roller assembly as claimed in claim 1 in which said concentrically assembled sleeves each have opposite ends and said rows of radial projections and outwardly extending hair-grasping hook shaped members are wider adjacent said opposite ends than the remaining rows.

5. A hair roller assembly comprising: concentrically arranged surface to surface engaged an outer tubular sleeve, an inner plastic resilient semi-flexible perforate tubular supporting sleeve within said outer tubular sleeve and a perforate intermediate tubular sleeve between said outer and inner sleeves, each of said sleeves having opposite ends;

said outer tubular sleeve is formed of a porous woven plastic material having plural circumferentially spaced relatively narrow rows formed of a plurality of radially outwardly extending flexible hair-grasping projections along the width thereof, said intermediate tubular sleeve being formed of thin aluminum, said intermediate tubular sleeve having plural spaced openings formed in rows along the circumferential surface thereof; and said inner plastic resilient semi-flexible perforate tubular plastic support sleeve having plural spaced strips extending longitudinally along the length thereof and plural coaxial spaced circular ridges extending along the length of said support sleeve and unitary with said spaced strips thereby to define plural openings between the opposite ends of said support sleeve.

6. A hair roller assembly as claimed in claim 5 in which said said circular ridges located adjacent the opposite ends of said inner plastic support sleeve are wider than the ridges therebetween.

7. A hair roller assembly as claimed in claim 5 in which said intermediate tubular sleeve has a longitudinal split along the length thereof.

8. A hair roller assembly as claimed in claim 5 in which said rows of hair-grasping projections adjacent said opposite ends are wider than said remaining rows.

* * * * *